US005883380A

United States Patent [19]

Sinor

[11] Patent Number: 5,883,380

[45] Date of Patent: Mar. 16, 1999

[54] NIGHT VISION DEVICE, IMPROVED IMAGE INTENSIFIER TUBE FOR SUCH A DEVICE HAVING REDUCED PARTICULATE CONTAMINATION AND METHOD OF MAKING

[76] Inventor: Timothy W. Sinor, 3836 Pine Valley Dr., Plano, Tex. 75025

[21] Appl. No.: 868,509

[22] Filed: Jun. 4, 1997

[51] Int. Cl.[6] ..... H01J 31/50

[52] U.S. Cl. ..... 250/214 VT; 313/103 CM; 313/105 CM; 313/524

[58] Field of Search ..... 250/207, 214 VT; 313/103 CM, 105 CM, 524–528, 532

[56] References Cited

U.S. PATENT DOCUMENTS

| | | | |
|---|---|---|---|
| 4,755,718 | 7/1988 | Patrick | 313/524 |
| 5,408,088 | 4/1995 | Chapman et al. | 250/214 VT |
| 5,767,621 | 6/1998 | De Hass et al. | 313/497 |

*Primary Examiner*—Stephone Allen
*Attorney, Agent, or Firm*—Terry L. Miller

[57] ABSTRACT

A night vision device includes an improved image intensifier tube providing an image with reduced dark spots caused by microscopic particulate contamination in the tube. A method of processing image intensifier tubes to reduce dark spots caused by such microscopic particulate contamination within the tubes is disclosed.

14 Claims, 3 Drawing Sheets

FIG. 3.
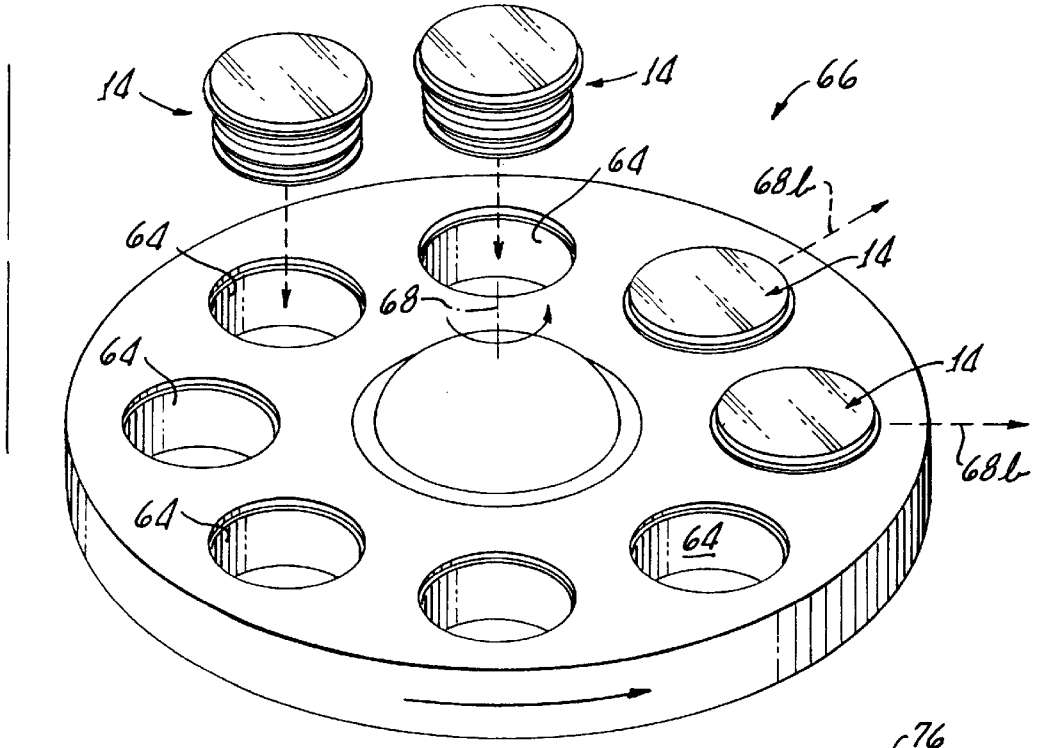
FIG. 4.
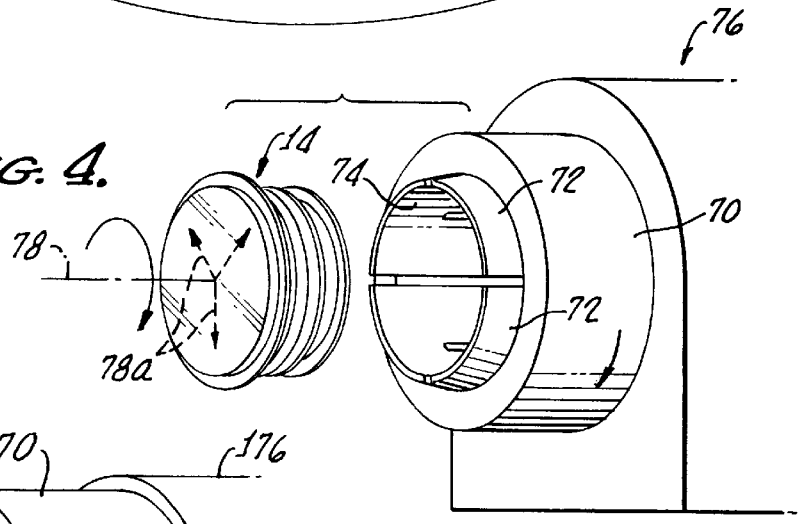
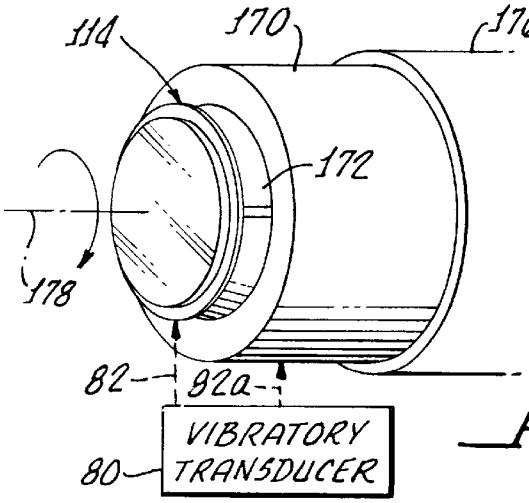
FIG. 5.

NIGHT VISION DEVICE, IMPROVED IMAGE INTENSIFIER TUBE FOR SUCH A DEVICE HAVING REDUCED PARTICULATE CONTAMINATION AND METHOD OF MAKING

BACKGROUND OF THE INVENTION

1. Field of the Invention

The present invention is generally in the field of night vision devices of the light amplification type. More particularly, the present invention relates to a night vision device having an improved image intensifier tube (I2T). A method of making such an improved image intensifier tube is disclosed also.

2. Related Technology

Even on a night which is too dark for diurnal vision, invisible infrared light is richly provided by the stars. Human vision can not utilize this infrared light from the stars because the so-called near-infrared portion of the spectrum is invisible for humans. A night vision device of the light amplification type can provide a visible image replicating the night-time scene.

Conventional night vision devices of the image intensification type (i.e., light amplification type) have been known for a considerable time. Generally, these night vision devices include an objective lens which focuses invisible infrared light from a night-time scene onto the transparent light-receiving face of an image intensifier tube. At its opposite image-face, the image intensifier tube provides an image in visible yellow-green phosphorescent light, which is then presented to a user of the device via an eye piece lens.

A contemporary night vision device will generally use an image intensifier tube with a photocathode behind the light-receiving face of the tube. The photocathode is responsive to photons of infrared light to liberate photoelectrons in a pattern replicative of the scene being viewed. These photoelectrons are moved by a prevailing electrostatic field to a microchannel plate having a great multitude of dynodes, or microchannels, with an interior surface substantially defined by a material having a high coefficient of secondary electron emissivity. The photoelectrons entering the microchannels cause a cascade of secondary emission electrons to move along the microchannels so that a spatial output pattern of electrons results, which pattern replicates the input pattern but is at a considerably higher electron density. This pattern of electrons is moved from the microchannel plate to an output electrode which includes a phosphorescent screen. The phosphorescent screen produces a visible image available through a transparent image-output window of the tube.

A persistent problem with image intensifier tubes has been the presence of microscopic contamination within the tube which interferes with the proper operation of the tube. Despite the best possible cleanliness and efforts to control contamination, the manufacturing process itself for an image intensifier tube probably produces some of this microscopic particulate contamination, so that it cannot be entirely eliminated. The particulate contamination within the tube causes dark spots of various sizes on the image produced by the tube. This problem of dark spots in the image provided by image intensifier tubes has been so pervasive and long-standing that the industry and users of such tubes have come to accept this problem, and to deal with it not by eliminating the problem but simply by grading its magnitude. That is, so long as the number and size of dark spots in an image intensifier tube are below a certain standard, the tube is judged to be acceptable. That is not to say that the images provided by presently accepted image intensifier tubes are free of dark spots, but simply that they provide images that is good enough.

SUMMARY OF THE INVENTION

In view of the deficiencies of the conventional related technology, it would be desirable to provide a night vision device which presents an image having fewer dark spots.

Additionally, it would be desirable to provide an image intensifier tube providing such an image that includes fewer dark spots.

A method of making such an image intensifier tube would also be desirable.

Accordingly, it is an object for this invention to provide a night vision device that avoids one or more of the deficiencies of the related technology.

Another object for this invention is to provide an image intensifier tube which avoids one or more of the deficiencies of the related technology.

Further, it is an object for this invention to provide a method of making an image intensifier tube which reduces the number of dark spots caused by microscopic particulate contamination within the tube.

Additional objects, features, and advantages of the present invention will be apparent to those skilled in the art from a consideration of the following detailed description of preferred exemplary embodiments of the invention, taken in conjunction with the appended drawing Figures.

BRIEF DESCRIPTION OF THE DRAWINGS

FIG. 3 is a schematic representation of a step in the process of making an improved image intensifier tube according to the present invention;

FIG. 4 provides a schematic representation of a step in the process of making an improved image intensifier tube utilizing alternative method according to the present invention;

FIG. 5 also provides a schematic representation of a step in the process of making an improved image intensifier tube utilizing yet another alternative method according to the present invention.

DETAILED DESCRIPTION OF AN EXEMPLARY PREFERRED EMBODIMENT OF THE INVENTION

Figure 1:
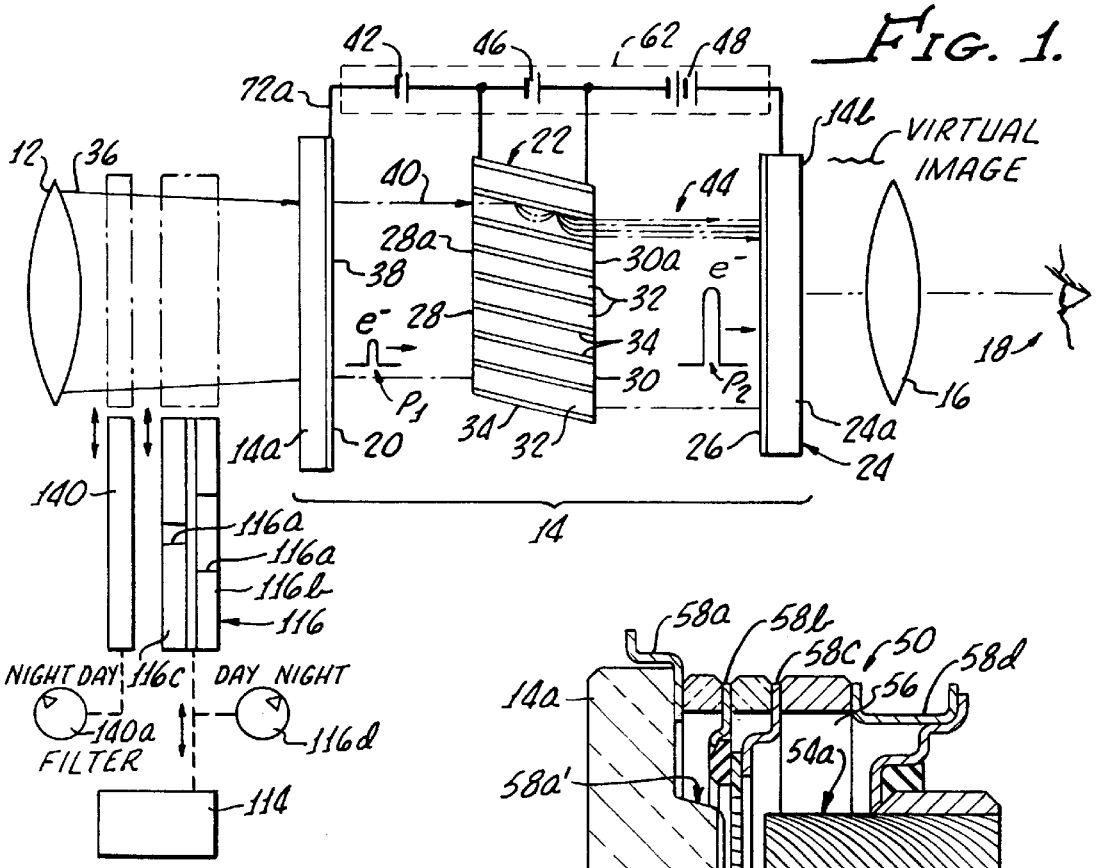
FIG. 1 is a schematic representation of an integrated night vision device including an improved image intensifier tube according to the present invention.

Referring first to FIG. 1, there is shown schematically the basic elements of one version of a night vision device. Device 10 generally comprises a forward objective optical lens assembly 12 (illustrated schematically as a single lens, although those ordinarily skilled will understand that the objective lens assembly 12 may include plural lens elements). This objective lens 12 focuses incoming light from a distant scene on the front light-receiving end 14*a* of an image intensifier tube 14 (as will be seen, this surface is defined by a transparent window portion of the tube 14—to be further described below). As was generally explained above in the discussion of the related technology, the image intensifier tube provides an image at light output end 14*b* in phosphorescent yellow-green visible light. This image replicates the scene being viewed by use of the device 10. The scene being viewed by use of device 10 may be a night-time scene which is invisible or only poorly visible to the user of the device 10. The visible image from tube 14 is presented by an eye piece lens illustrated schematically as a single lens 16 producing a virtual image of the rear light-output end 14*b* of the tube 14 at the user's eye 18.

More particularly, image intensifier tube 14 includes a photocathode 20 which is responsive to photons of light to liberate photoelectrons in a pattern replicating the scene being viewed; a microchannel plate 22 which receives the photoelectrons in the pattern replicating the scene, and which provides a greatly amplified pattern of electrons also replicating this scene; and a display electrode assembly 24 having an aluminized phosphor coating or phosphor screen 26. A transparent window portion 24*a* of the assembly 24 conveys the image from screen 26 outwardly of the tube 14 so that it can be presented to the user 18.

Still more particularly, microchannel plate 22 is located just behind photocathode 20, with the microchannel plate 22 having an electron-receiving face 28 and an opposite electron-discharge face 30. This microchannel plate 22 further contains a multitude (perhaps as many as a million or more) of angulated microchannels 32 which open on the electron-receiving face 28 and also on the opposite electron-discharge face 30. These microchannels 32 are disposed in a central active area of the plate, within a surrounding rim portion providing for mounting of the plate to electrically conductive support structures of the tube, as will be further explained. The microchannels 32 may be of about 6 microns diameter, so that microscopic particulate contamination within the tube 14 could partially or fully block some of these microchannels. Microchannels 32 are separated by passage walls 34. At least a portion of the surfaces of the walls 34 bounding the microchannels 32 is formed by a material having a high coefficient of emissivity of secondary electrons. Thus, the channels 32 of the microchannel plate 22 are each a dynode, emitting a shower of secondary electrons in response to receipt at face 28 of photoelectrons from photocathode 20.

The display electrode assembly 24, generally has a coated phosphor screen 26, is located behind microchannel plate 22 with phosphor screen 26 in electron line-of-sight communication with the electron-discharge face 30. Display electrode assembly 24 is typically formed of an aluminized phosphor screen 26 deposited on the vacuum-exposed surface of the optically transparent material of window portion 24a. The eye piece lens 16 is located behind the display electrode assembly 24 and allows an observer 18 to view a correctly oriented image corresponding to the initially received low level image.

As will be generally appreciated by those skilled in the art (now also viewing FIG. 2), the individual components of image intensifier tube 14 are all mounted and supported in a tube or chamber (to be further explained below) having forward and rear transparent plates cooperating to define a chamber (to be further defined below) which has been evacuated to a low pressure. This evacuation allows any electrons liberated into the free space within the tube to be transferred by prevailing electro static fields between the various components without atmospheric interference that could possibly decrease the signal-to-noise ratio.

As indicated above, photocathode 20 is mounted immediately behind objective lens 12 on the inner vacuum exposed surface of window the window portion of the tube and before microchannel plate 22. Typically, this photocathode 20 is a circular disk-like structure having a predetermined construction of semiconductor materials, and is mounted on a substrate in a well known manner. Suitable photocathode materials are generally semiconductors such as gallium arsenide; or alkali metals, such as compounds of sodium, potassium, cesium, and antimony (commercially available as S-20), carried on a readily available transparent substrate. A variety of glass and fiber optic substrate materials are commercially available.

Figure 2:
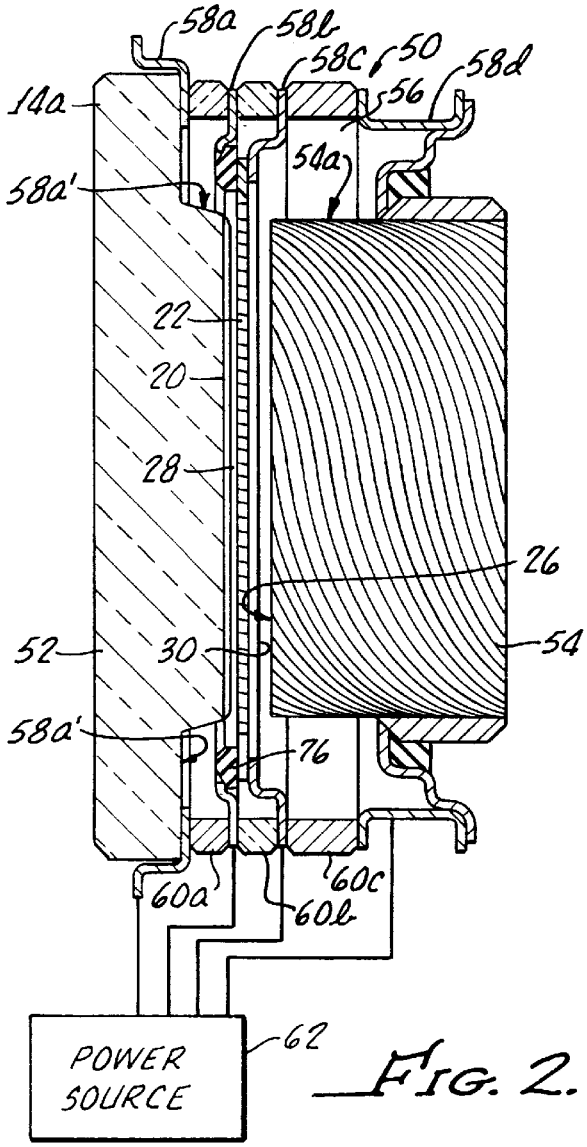
FIG. 2 shows a typical image intensifier tube in longitudinal cross section.

Still referring to FIG. 2, and considering in somewhat greater detail the operation of the image intensifier tube 14 in its mode of operation providing a visible image it is seen that in response to photons 36 entering the forward end of night vision device 10 and passing through objective lens 12, photocathode 20 has an active surface 38 from which are emitted photoelectrons in numbers proportionate to and at locations replicative of the received light from the scene being viewed. In general, at night the image received by the device 10 will be too dim to be viewed with human natural vision, and may be entirely or partially of infrared radiation which is invisible to the human eye. The device may also operate in daylight to provide an image, as will be explained. It is thus to be understood that the shower of photoelectrons emitted from the photocathode are representative of the image entering the forward end of image intensifier tube 14. The path of a typical photoelectron emitted from the photon input point on the photocathode 20 is represented in FIG. 1 by dashed line 40.

Photoelectrons 40 emitted from photocathode 20 gain energy by passage through an applied electrostatic field between the photocathode 20 and the input face 28. The applied electric field is of a predetermined intensity gradient and is established between photocathode 20 and electron-receiving face 28 by a power source diagrammatically depicted in FIG. 1 and indicated by the numeral 42. Typically, power source 42 will apply an electrostatic field voltage on the order of 200 to 800 volts to maintain an electrostatic field of the desired intensity. This field is most negative at photocathode 20 and most positive at the face 28 of microchannel plate 22. Further, an electrostatic field most negative at photocathode 20 and most positive at output electrode 24 is maintained in the image intensifier tube 14, as will be seen. After accelerating over a distance between the photocathode 20 and the input face 28 of the microchannel plate 22, these photoelectrons 40 enter microchannels 32.

As will be discussed in greater detail below, the photoelectrons 40 are amplified by emission of secondary electrons in the microchannels 32 to produce a proportionately larger number of electrons upon passage through microchannel plate 22. This amplified shower of secondary-emission electrons 44, also accelerated by a respective electrostatic field applied by power source 46, then exits from the microchannels 32 of microchannel plate 22 at electron-discharge face 30. The line of movement of electrons 40 and 44 defines an operational axis for the tube 14, which might be referred to also as an "optical" axis, even though it represents a flow of electrons. Internally of the tube 14, these electrons are representative of an image. Further, the windows 14 and 24 do respectively admit and provide optical images to and from the tube 14, so a reference to an optical axis for the tube 14 is consistent with this operation. The central optical axis for the tube 14 is indicated by a dashed line extending to the user 18.

Once in free space again, the amplified shower of photoelectrons and secondary emission electrons is again accelerated in an established electrostatic field provided by power source 48. This electrostatic field is established between the electron-discharge face 30 and display electrode assembly 24. Typically, the power source 48 produces a field on the order of 3,000 to 7,000 volts, and more preferably on the order of 6,000 volts in order to impart the desired energy to the multiplied electrons 44.

The shower of photoelectrons and secondary-emission electrons 44 (those ordinarily skilled in the art will know that considered statistically, the shower 44 is almost or entirely devoid of photoelectrons and is made up entirely or almost entirely of secondary emission electrons. This is the case because statistically the probability of a photoelectron avoiding absorption in the microchannels 32 is low). However, the shower 44 is several orders of magnitude more intense than the initial shower of photoelectrons 40, but is still in a pattern replicating the image focused on photocathode 20. This amplified shower of electrons falls on the phosphor screen 26 of display electrode assembly 24 to produce an image in visible light.

Viewing FIG. 2 in order to acquire a greater understanding of the detail of a typical image intensifier tube, the image intensifier tube 14 is seen to include a tubular body 50, which is closed at opposite ends by a front light-receiving window 52, and by a rear fiber-optic image output window 54. The window 54 defines the light output surface 14*b* for the tube 14, and carries the coating 26, as will be further described. As is illustrated in FIG. 2, the rear window 54 may be an image-inverting type (i.e., with optical fibers bonded together and rotated 180° between the opposite faces of this window 54 in order to provide an erect image to the user 18. The window member 54 is not necessarily of such inverting type. Both of the windows 52 and 54 are sealingly engaged with the body 50, so that an interior chamber 56 of the body 50 can be maintained at a vacuum relative to ambient. During manufacture of the tube 14, precautions available with modern clean room technology are observed in order to prevent the introduction of contaminants into the chamber 56. However, as discussed above, microscopic contamination is still generally present in the chamber 56 of modern image intensifier tubes, either from the environment or because of the manufacturing process itself.

The tubular body 50 is made up of plural metal rings, each indicated with the general numeral 58 with an alphabetical suffix added thereto (i.e., 58*a*, 58*b*, 58*c*, and 58*d*) as is necessary to distinguish the individual rings from one another. The tubular body sections 58 are spaced apart and are electrically insulated from one another by interposed insulator rings, each of which is indicated with the general numeral 60, again with an alphabetical suffix added thereto (i.e., 60*a*, 60*b*, and 60*c*). The sections 58 and insulators 60 are sealingly attached to one another. Most usually, the rings 58 and insulators 60 are vacuum furnace brazed to one another, with the vacuum within chamber 56 being captured during this furnace brazing operation. End sections 58 and 58*d* are likewise sealingly attached to the respective windows 52 and 54. The particulate contaminants within chamber 56 may in part originate with this vacuum furnace brazing operation.

During operation of the tube 14, the body sections 58 are individually connected electrically to the power supplies 42, 46, and 48, as is schematically depicted in FIG. 1. It is seen that the front window 52 carries on its rear surface within the chamber 56 the photocathode 20. The section 58*a* is electrically continuous with the photocathode by use of a thin metallization (indicated with reference numeral 58*a*') extending between the section 58*a* and the photocathode 20. Thus, the photocathode by this electrical connection and because of its semi-conductive nature, has an electrostatic charge distributed across the areas of this disk-like photocathode structure. Also, a conductive coating or layer is provided at each of the opposite faces 28 and 30 of the microchannel plate 22 (as is indicated by arrowed numerals 28*a* and 30*a*).

Power supply 46 is conductive with these coatings by connection to housing sections 58*b* and 58*c*. Finally, the power supply 48 is conductive with a conductive layer or coating (possibly an aluminum metallization, as mentioned above) at the display electrode assembly 24 by use of a metallization also extending across the vacuum-exposed surfaces of the window member 54, as is indicated by arrowed numeral 54*a*. Electrons flow in the tube 14 as a result of the applied electrostatic fields, as discussed above. Also, any gas molecules still present in the chamber 56 may become positively charged and will flow in the opposite direction of the electrons (i.e., from right to left in the gap between the photocathode 20 and screen 26. This is the case also with respect to microscopic contaminants present in the chamber 56.

However, under vacuum conditions and at the sizes of gas molecules and microscopic contaminant particles which may be present in the chamber 56 and have an effect at the microchannels 32 and other structures affecting the operation of the tube 14, it will be recognized that molecular adhesion forces are quite strong. That is, the microscopic contaminant particles present in the chamber 56 may not be freely mobile. Instead these particles may adhere and remain in what ever location they happen to initially have, and for this reason may remain in place obstructing one or more of the microchannels 32 during operation of the tube 14.

However, the Applicant has discovered that it is possible to remove a substantial portion of the contaminants which may be present within chamber 56 to a location in which they do not interfere with the operation of the tube 14. Viewing FIG. 2, it is seen that the chamber 56 includes a relatively large volume of space which is not in the line-of-sight electron flow between photocathode 20 and screen 26. That is, there is a considerable circumferential volume, indicated with the arrowed numerals 62 where contaminants could reside and not interfere with the operation of the tube 14.

Further viewing FIG. 3, one step in the process of making an image intensifier tube 14 according to the present invention is depicted. In this step, complete image intensifier tubes 14, which have been furnace brazed and are ready for operation, are loaded into respective cavities 64 of a centrifuge 66 having a rotor 68. The rotor 68 defines the cavities 64, and is rotational about its own axis 68*a* to provide radially directed centrifugal acceleration vectors (indicated with dashed arrows 68*b*), each passing radially through a respective cavity 64 at right angles to the operating axis of the image tubes 14 received into these cavities.

In order to move particular contaminants which may be present in the tubes 14 into an area indicated with the numeral 62 on FIG. 2, the centrifuge and tubes 14 seen in FIG. 3 are spun at a high speed. The centrifugal forces (i.e., indicated by arrows 68*b* will fling the particulate contaminants away from the gap between photocathode 20 and screen 26. Experience has shown that the particulate contaminants once moved away from the gap between the photocathode 20 and screen 26 will not return to their former locations. Operation of the tube 14 is improved because dark spots caused by the presence of the particulate contaminants are eliminated. That is again, the acceleration vectors 68*b* extend perpendicularly to the optical axis of the tubes 14, and are parallel to the plane of the microchannel plates 22 in these tubes. This parallelism of the acceleration vectors 68*b* with the microchannel plates 22 of the image intensifier tubes 14 is important because it causes particulate contaminants in the tubes to be flung outwardly away from the axis 68*a*, and into a part of the volume 62. These particulates will be trapped in the volume 62 by molecular adhesion, and will not return onto the microchannel plates of the tubes to cause dark spots.

FIG. 4 provides a diagrammatic view of a step in an alternative method of making an improved image intensifier tube according to this invention. In the step illustrated by FIG. 4, a collet 70 is provided. Collet 70 includes plural collet fingers 72, cooperatively defining a cavity 74 which is sized and configured to receive an image intensifier tube 14. Collet 70 is journaled and driven for rotation at a high speed by a drive assembly 76. The tube 14 has been vacuum furnace brazed, and is ready for operation. However, in order to improve the operation of the tube 14, it is placed into collet 70 and is spun about its own central optical axis (indicated with arrowed numeral 78. In this case, a centrifugal force field (indicated by arrowed numerals 78*a*) is created extending in all directions radially from the axis 78. This centrifugal force field will move particulate contaminants in cavity 56 into the volume 62. Particularly, it is to be noted that the acceleration force field 78*a* is parallel to the plane of the microchannel plate 22, and thus will move particulates on and adjacent to this plate toward the outer perimeter of the microchannel plate. The volume 62 includes areas adjacent to the outer perimeter of the faces 28 and 30 of the microchannel plate into which these particulates can be received to there be trapped by molecular adhesion. These particulates once moved into the volume 62 will remain there, and will not return onto the microchannel plate to cause dark spots in the image provided by the tube 14. Thus, contaminants which may be present in image intensifier tubes processed according to this embodiment also will be improved in their operation.

FIG. 5 provides a diagrammatic view of a step in another alternative method of making an improved image intensifier tube according to this invention. The method illustrated by FIG. 5 is similar to that of FIG. 4 except as noted. For this reason, the features seen in FIG. 5 are indicated with the same numeral used above, but increased by one-hundred (100) relative to FIG. 4. In the step illustrated by FIG. 5, a collet 170 is provided. Collet 170 also includes plural collet fingers 172 defining a cavity 174 which is sized and configured to receive an image intensifier tube 14. In this case, a vibratory transducer 80 (which may operate below audible frequency, within the audible frequency range, or ultrasonically) is associated with the image tube 14 during its spin in the collet 170. The nature of the association is such that vibrations from the transducer are communicated to tube 14, and cause the tube 14 to be vibrated or agitated.

Figure 6:
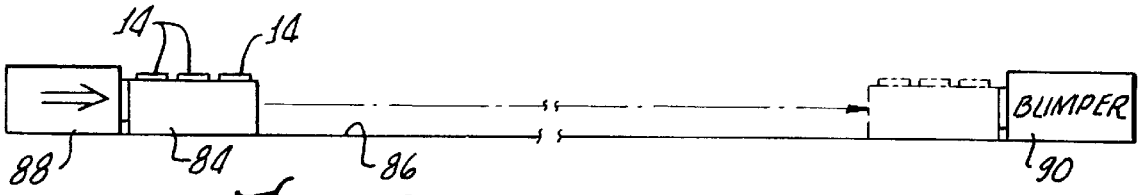
FIGS. 6–8 each respectively depict diagrammatically a step in a process of making an improved image intensifier tube, each utilizing an alternative process according to the present invention.

As indicated by dashed arrow 82, the transducer 80 may be associated directly with the tube 14. This direct association may be accomplished by extending a physical vibratory conductor (not shown) from the transducer 80 to contact with the tube 14 being processed. Alternatively, as is suggested by dashed arrow 82*b*, the transducer may be associated with the collet 170, with vibrations being conducted through the collet 170 to the tube 14 being processed. Still alternatively, the transducer 80 may operate in the auditory or ultrasonic range, with the vibrations from this transducer being conveyed through the air to the tube 14 under processing. In this case, the nature of the association 82 may be accomplished by use of a speaker horn or ultrasonic drive horn aimed at the tube 14. In each case, the vibrations provided by transducer 80 are thought to assist in agitating particulate contaminants in the tube 14, so that these contaminants are dislodged from their repose in the cavity 56 (recalling the explanation above about molecular adhesion). Once the particulates are dislodged, they are moved by the centrifugal force field 178*a* to the areas 62 (recalling FIG. 2). considering now FIGS. 6–8 in conjunction with one another, steps in alternative processes of making an improved image intensifier tube are diagrammatically depicted. FIG. 6 shows an embodiment of the invention in which an image intensifier tube 14 is mounted in a holder aboard a movable sled 84. This sled is accelerated along a guide way 86 by a device 88 applying a linear force sufficient to accelerate the sled to a high speed. At the far end of the guide way 86, a resilient bumper 90 is located, against which the sled 84 impacts to stop. In other words, the image intensifier tubes 14 are accelerated to a high speed and then stopped suddenly. The sled 14 in this case is depicted as holding three image intensifier tubes, although the invention is not limited to any particular number of tubes. The mechanism used in this case to decelerate the sled is a resilient bumper against which the sled impacts to suddenly stop the motion of the image intensifier tubes. It is appreciated that in this case the applied acceleration is a deceleration, and that the process is one of an impulsive acceleration (i.e., a deceleration) being applied to the image tubes 14. It is also apparent that other mechanisms could be used to effect the sudden deceleration of the sled 84 in a linear process.

Figure 7:
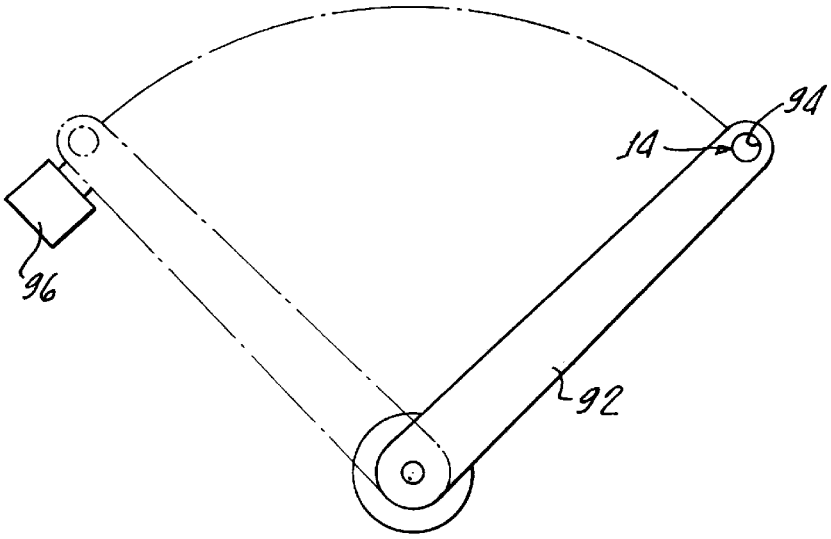

FIG. 7 shows a "hammer" process of acceleration processing image tubes. In this process, an arm 92 is provided near its distal end with a holder 94 for an image tube 14. A drive device (not shown) is effective to forcefully accelerate the arm 92 arcuately toward a bumper 96. During this arcuate motion, a centrifugal force will apply to the image tube. Further, upon reaching and striking the bumper 96 the arm 92 and image tube 14 stops suddenly. Again, the image tube is subjected to an impact acceleration, which in this case also is a deceleration. The device shown in FIG. 7 applies a combination of accelerations to the image tube 14 being processed.

Figure 8:
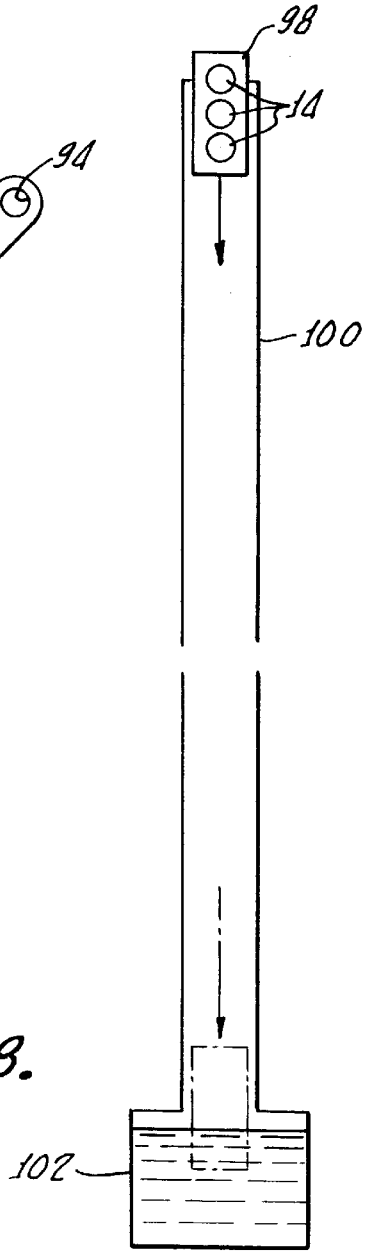

Finally, viewing FIG. 8, a linear dropping type of acceleration processing for image tubes is depicted. In this case, the image tubes 14 are placed in a protective capsule 98, which is allowed to fall by gravity down a guide way 100. At the bottom of the guide way, the capsule impacts into a water filled tank 102. The impact of the capsule (and of the image tubes within this capsule) with the water in tank 102 can be well and repeatably controlled.

In each case described above, the acceleration applied to the image tubes being processed is most desirably parallel to the microchannel plate 22 of the tubes. However, it is to be recognized that all that is required is that the applied acceleration have a component parallel to the microchannel plate. Thus, other orientations of an image tube with respect to the applied acceleration may be utilized within the scope of this invention. As was seen with the embodiment of FIG. 7 also, combinational accelerations may be employed.

Thus, it will be recognized further that the same acceleration which is effective to move particulate contaminants to the outer periphery of the microchannel plate is also effective to similarly move particulates which may be adhered to the photocathode 20 or to the screen 26. These particulates may also contribute to spotting in the image of an image intensifier tube. However, the present acceleration processing method clears particulate contaminants away from the active areas of a tube and to the outer volume 62, providing an image intensifier tube in most cases which has fewer dark spots. In cases where some dark spotting does remain after processing by acceleration in accord with this invention, the spotting is of smaller size and fewer in number than had been the case before processing in accord with this invention.

Those skilled in the art will appreciate that the embodiment of the present invention depicted and described herein and above is not exhaustive of the invention. Those skilled in the art will further appreciate that the present invention may be embodied in other specific forms without departing from the spirit or central attributes of the invention. Thus, it is seen that this invention achieves its objectives, and provides an important advance in the art of light amplification night vision devices.

Because the foregoing description of the present invention discloses only exemplary embodiments, it is to be understood that other variations are recognized as being within the scope of the present invention. Accordingly, the present invention is not limited to the particular embodiments which have been depicted and described in detail herein. Rather, reference should be made to the appended claims to define the scope and content of the present invention.

I claim:

1. A method of making a night vision device having an improved image intensifier tube which provides an image with a reduced number of dark spots caused by microscopic particulate contamination within the image intensifier tube, said method comprising steps of:

assembling and sealing said image intensifier tube to capture a vacuum within the chamber of the tube;

applying an acceleration to said image intensifier tube having a component parallel to a microchannel plate of the tube; and using said acceleration to move a microscopic particulate contaminate within said tube away from an active area of the microchannel plate.

2. The method of claim 1 wherein said step of applying the acceleration to the image intensifier tube is selected from the group consisting of: spinning the image intensifier tube about its own optical axis, spinning the image intensifier tube about an axis spaced from the tube's own optical axis; moving the image intensifier tube linearly to a zone of sudden deceleration, moving the image intensifier tube arcuately to a zone of sudden deceleration, and dropping the image intensifier tube under gravitational acceleration to a zone of sudden deceleration.

3. The method of claim 1 further including the step of applying a vibrational input to the image intensifier tube.

4. The method of claim 3 further including the step of applying the vibrational input to the image intensifier tube simultaneously with the application of the acceleration parallel to the microchannel plate.

5. A method of processing an image intensifier tube in order to move a microscopic particulate contaminant within the tube, said method comprising steps of:

applying an acceleration to the image intensifier tube, this acceleration having a component substantially parallel to a microchannel plate of the tube; and using said acceleration to move a microscopic particulate contaminate within the tube.

6. The method of claim 5 further including providing an outer peripheral portion of a chamber within the tube, and moving the particulate contaminant away from an active area of the microchannel plate and toward this peripheral portion of the chamber.

7. The method of claim 5 wherein said step of applying the acceleration to the image intensifier tube includes spinning the image intensifier tube about its own optical axis.

8. The method of claim 5 wherein said step of applying the acceleration to the image intensifier tube includes centrifuging the image intensifier tube about an axis spaced from the tube's own optical axis.

9. The method of claim 5 wherein said step of applying the acceleration to the image intensifier tube includes accelerating the tube and then stopping its motion suddenly.

10. The method of claim 9 wherein the sudden stopping of the image intensifier tube is effected by applying a deceleration force to the tube.

11. The method of claim 5 further including the step of applying a vibrational input to the image intensifier tube.

12. The method of claim 11 further including the step of applying the vibrational input to the image intensifier tube simultaneously with the application of the acceleration parallel to the microchannel plate.

13. The method of claim 5 wherein said step of applying the acceleration to the image intensifier tube includes applying a combinational acceleration to the image intensifier tube.

14. A method of making a night vision device with fewer dark spots in an image provided by the device, said method comprising steps of:

providing an objective lens;

providing an image intensifier tube;

utilizing the objective lens to focus light from a scene on a light-receiving surface of the image intensifier tube;

utilizing the image intensifier tube to responsively provide an image replicating the scene;

providing an eye piece lens to produce for a user of the device a virtual image replicating the scene;

subjecting the image intensifier tube to an acceleration having a component substantially parallel to a microchannel plate of the tube; and utilizing the acceleration to move a particulate contaminant within the tube away from an active areas of the tube.

* * * * *